US005233909A

United States Patent [19]

Von Hoene

[11] Patent Number: 5,233,909

[45] Date of Patent: Aug. 10, 1993

[54] INTEGRAL REGENERATIVE FLUID SYSTEM

[75] Inventor: H. Michael Von Hoene, Cary, N.C.

[73] Assignee: Decatur Cylinder, Inc., Decatur, Ala.

[21] Appl. No.: 916,265

[22] Filed: Jul. 21, 1992

[51] Int. Cl.[5] ..... F15B 11/08; F15B 13/04

[52] U.S. Cl. ..... 91/436; 91/461

[58] Field of Search ..... 91/436, 440, 461; 92/110, 112, 108

[56] References Cited

U.S. PATENT DOCUMENTS

| | | | |
|---|---|---|---|
| 3,068,596 | 12/1962 | Hein et al. | 91/436 |
| 3,474,708 | 10/1969 | Schmiel | 91/436 |
| 3,858,485 | 1/1975 | Rosaen et al. | 91/436 |
| 4,194,436 | 3/1980 | Imada | 91/436 X |
| 4,362,018 | 12/1982 | Torii | 91/436 X |
| 4,397,221 | 8/1983 | Friesen et al. | 91/436 X |
| 4,635,532 | 1/1987 | Tanino et al. | 91/436 |
| 5,038,669 | 8/1991 | Maruyama | 91/440 X |

*Primary Examiner*—Edward K. Look
*Assistant Examiner*—John Ryznic
*Attorney, Agent, or Firm*—John C. Garvin, Jr.; James E. Staudt

[57] ABSTRACT

This integral regenerative system is particularly well suited for retrofitting to standard hydraulic systems which did not originally employ regeneration circuitry. To reduce the amount of external plumbing and valving normally associated with retrofitting, the invention utilizes the integration of uniquely directed flow paths and specially configured valves into its housing components. The valves provide fluid flow control within the system and automatically prevent undesirable drainage of fluid from the system.

6 Claims, 1 Drawing Sheet

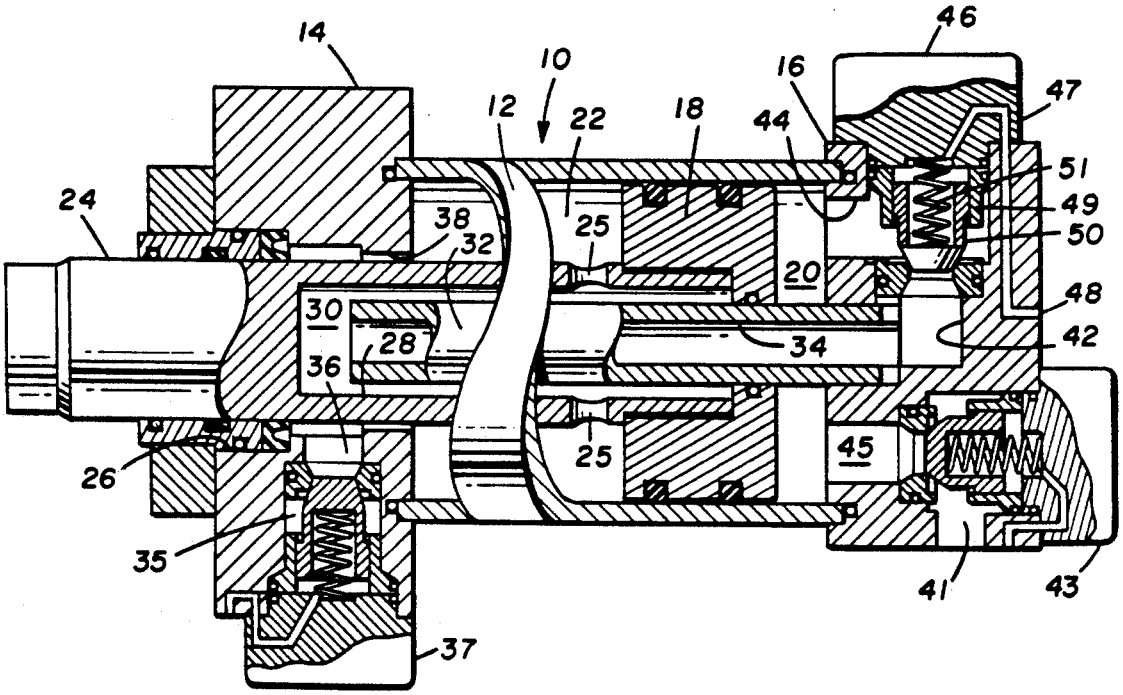
14
10
12
22
18
16
44
46
47
51
49
50
48
42
24
38
32
25
20
30
28
36
34
26
25
45
35
41
43
37

INTEGRAL REGENERATIVE FLUID SYSTEM

BACKGROUND OF THE INVENTION

1. Field of the Invention

The present invention addresses the problems associated with hydraulic regenerative circuitry. By integrating unique valving and associated flow paths within a regenerative fluid system the performance of the system is greatly improved while the complexity and cost of the system is significantly reduced. Additionally, an improved regeneration reverse mode can now be employed which reduces the overall cycle time as compared to standard circuitry. Significantly, this system is more easily retrofitted to a standard hydraulic system which did not originally employ regeneration circuitry.

2. Description of the Related Art

Regenerative circuitry reduces cycle time for the forward motion of hydraulic cylinders. This is accomplished by externally directing the flow out of the rod end of a hydraulic cylinder and combining this flow with the flow from a supply pump, then directing this combined flow into the blind end of the cylinder. With prior art devices this process required that the external plumbing and valving associated with this flow path be greatly enlarged to handle the increased volume of fluid which must be transferred when utilizing a regenerative system. The cost of larger components and the labor required for their installation typically increased the expense of implementation of a retrofitted regenerative system beyond practicality.

Examples of related prior art are found in the following U.S. Pat. Nos. 3,476,014 to Churchill et al; 3,817,152 to Viron; 3,858,485 to Rosaen at al; 4,955,282 to Ranson; 4,375,181 to Conway; and 5,090,296 to Todd.

SUMMARY OF THE INVENTION

The present invention eliminates the above mentioned as well as other shortcomings of the prior art by integrating the components and flow paths required to effect the implementation of a regenerative circuit. An additional benefit of this design provides improved regenerative capabilities in the return stroke. This integral regenerative system can be easily and economically retrofitted to a standard hydraulic system which did not originally employ regeneration circuitry.

The present invention accomplishes these functions with the integration of uniquely directed flow paths with specially configured valves. These valves are integral with the system. They provide a unique fluid flow control within the system and automatically prevent undesirable drainage of fluid from the system.

In the present system, a tube is attached internally to the blind end of a hydraulic cylinder. The tube is in selective communication with fluid in the blind end of the cylinder through valved passages integrated into the blind end of the cylinder, and is disposed to extend into a hollow piston rod. The piston rod is internally ported to this tube providing a flow path for fluid surrounding the rod to be combined with the fluid in the blind end of the system during extension of the rod.

Of importance is the fact that the integral valves open only when a fluid flow is required and remain in a closed position at all other times during or after operation of the system. This feature assures that fluid within the system at any given time is prevented from draining from the system. In this way, the fluid necessary for the regeneration operations of the system is maintained in its appropriate chamber, and no air is allowed into the system by leak down with the system.

As indicated above, it is an object of this invention to provide a fluid system which overcomes the shortcomings found in the prior art and to provide an integrated regenerative fluid system which system is efficient, economical to construct and install and is particularly well suited for retrofitting to a fluid system which was not originally designed for use of a regenerative system.

These and other objects of the invention will be apparent to one skilled in the art from the following detailed description of specific embodiments thereof.

BRIEF DESCRIPTION OF THE DRAWINGS

The figure is a longitudinal sectional view of a preferred embodiment of the invention with some portions shown in elevation.

DESCRIPTION OF PREFERRED EMBODIMENTS

Referring now to the drawing, the figure illustrates an integral regenerative fluid system which is the subject of the invention. A cylindrical housing generally referred to by numeral 10 provides the supporting structure for the system. The housing 10 includes a cylinder 12 which is attached at one end thereof to a head 14, and at the other end thereof, which is commonly referred to as the blind end, to a cap 16. A piston 18 is slidably mounted in the cylinder 12 so as to define an extend chamber 20 between the piston 18 and the cap 16, and a retract chamber 22 between the piston 18 and the head 14. A rod 24 is attached at one end thereof to the piston 18 and passes through an opening 26 in the head 14. As illustrated, the rod is slidably mounted within the opening 26 which is provided with appropriate sealing means. The rod 24 includes a hollowed portion 28 which defines a regeneration chamber 30. Ports 25 are formed on the rod 24 adjacent the piston 18 to provide communication between the retract chamber 22 and the regeneration chamber 30. A cylindrical regeneration tube 32 is attached at one end to the cap 16. The tube 32 passes through an opening 34 is the piston 18. The piston opening 34 is provided with appropriate sealing means whereby a sealed slidable relationship is established between tube 32 and piston 18. The head 14 is provided with a head passage 36 which provides communication between the exterior of the head and the retract chamber 22 through a relieved portion 38, which is also formed in the head 14. The passage 36 is provided with a cartridge valve 37 for selective opening and closing between the passage 36 and a passage 35. The passage 35 is adapted for connection to selected exterior equipment which may selectively provide either fluid under pressure fed to the system or a reservoir for containing fluid exhausted from the system. Details describing the operation of the modified cartridge valves used in this system will be discussed later in this specification. A primary passage 41 is formed in cap 16. The passage 41 is adapted for connection to selected exterior equipment which may selectively provide either fluid under pressure fed to the system or a reservoir for containing fluid exhausted from the system. The passage 41 is provided with a cartridge valve 43 which permits selective communication between the primary passage 41 and a passage 45 which opens into the extend chamber 20. Cap 16 is also provided with passages 42 and 44 which communicate with one another in accordance with a position of a regeneration cartridge valve 46.

Since cartridge valve technology is an integral part of the integrated regeneration system, a brief description of the principles of operation of these valves is provided. Poppet type valves have been used in hydraulic systems for many years. They are commonly known as two port check valves. With some refinements, these valves can be controlled to overcome the normal blocking action, thereby allowing control of flow in both directions. This is the basis of the control concept known as cartridge valves. Cartridge valves are similar to poppet check valves and consist of an insert assembly that slips into a machined cavity. As an example of the cartridge valve configuration utilized in the present invention, reference is made to cartridge valve 46. In this example, a sleeve 49, a poppet 50, a spring 51 and appropriate seals, are retained in the valve assembly by a control cover 47. This cover 47 is bolted to cap 16. The valve may be defined as a fluid piloted bi-directional check valve. In operation of the valve, fluid under pressure is selectively supplied to a pilot port, such as is indicated by numeral 48. When such pressure is applied, the cartridge valve remains firmly closed, so as to prevent flow past the poppet. This mode of the valve operation is defined as a "high bias state". When the port is under little or no pressure, the cartridge valve is said to be in a "low bias state" and fluid may pass in either direction past the poppet with minimal pressure being applied. It will be understood that the configuration of the poppet provides a significant pressure surface area perpendicular to the direction of movement of the poppet in its sleeve. A portion of this pressure surface area is exposed to fluid on either side of the closed poppet. Thus when a fluid pressure differential exists on either side of a closed poppet a force component is created in a direction which will tend to move the poppet toward an open position. This design permits fluid flow in either direction past the poppet when a predetermined fluid pressure differential exists across the valve. For use in this application, the spring between the cover 46 and the poppet 50 is designed to exert a bias against the poppet sufficient to prevent gravitational flow of fluid from the system but low enough to provide flow in either direction in response to a small pressure differential on either side of the poppet. As will be readily understood, when valve 46 is in a low bias state, communication is effectively established between passages 42 and 44 which together provide communication between the extend chamber 20 and the regeneration chamber 30 through the tube 32. To block the flow through the valve, pressure is applied through the pilot port 48 to the poppet 50 thus placing the cartridge valve 46 in its high bias state.

It will be understood that each of the cartridge valves 37, 43 and 46, incorporated in the system, operate in like manner and may be controlled in response to desired parametric conditions taken from within the system, such as selected chamber pressures or piston position, or the valves may be controlled from parameters outside the system if so desired. It is to be further understood that operation of the valve is particularly well suited to operation by the application of pneumatic as well as hydraulic pressure. In using a pneumatic medium, the low bias operational state of the valve is to be accomplished by elimination of spring 51, and the application of a low pneumatic pressure to the poppet. The high bias state would, of course, be accomplished by an appropriate increase in the pilot pressure.

Three general modes of operation are utilized by the system. These modes are as follows:

Mode One—Extension With Regeneration

To extend the rod 24, fluid under pressure is supplied by conventional means to the primary passage 41. The head passage 36 of the cylinder is blocked by placing cartridge valve 37 in its high bias state. Fluid under pressure is fed into passage 41, across cartridge valve 43 which is maintained in its low bias state. Regeneration cartridge valve 46 is also in its low bias state. As the cylinder extends, fluid in the retract chamber 22 flows through the ports 25 in the base of the rod 24, into regeneration chamber 30, through the regeneration tube 32 and passage 42, through the regeneration cartridge valve 46, through passage 44, and combines with the oil entering the extend chamber 20 from cap passage 41.

Mode Two—Conventional Extension, No Regeneration

To change to conventional mode when a load is encountered, regeneration cartridge valve 46 is placed in its high bias state by directing fluid at a predetermined pressure into pilot port 48, and the fluid from the retract chamber 22 is exhausted from the system through the head passage 36 and through the cartridge valve 37 which is in its low bias state and finally through passage 35. The fluid volume that is exhausted through this operation is reduced by the volume still required to fill the expanding regeneration chamber 30. It will be noted that full tonnage of the system as compared to a nongenerative cylinder is reduced only by the cross sectional area of the regeneration tube 32.

Mode Three Retract—With Regeneration

Regeneration—retract is accomplished by placing cartridge valve 37 in its low bias state, and feeding fluid under pressure into the head passage 36 of the system. Regeneration cartridge valve 46 remains in its high bias state by maintaining pressure at pilot port 48. The fluid in the regeneration chamber 30 is forced to flow through the ports 25 in the piston rod 24 into retract chamber 22 where it combines with the flow from head passage 36. This combination of fluid already in the system with fluid being fed to the system provides the regeneration flow required for rapid return of the piston and rod assembly. The fluid from the extend chamber 20 is exhausted through passage 45, cartridge valve 43 which is in its low bias state and exhausted through passage 41.

Of importance is the fact that the integral cartridge valves open only when a fluid flow is required and remain in a closed position at all other times during or after operation of the system. This feature assures that fluid with the system at any given time is prevented from draining from the system. In this way, the fluid necessary for the regeneration operations of the system is maintained in its appropriate chamber, and no air is allowed into the system by leak down within the system.

From the above specification, it is clear that the present invention proves a totally integrated system which provides superior performance, compactness and simplicity in operation and installation not found in any known prior art. In addition, the unique integration of passages and valving provide a system which is economical to manufacture. Of great importance also are the savings which are realized in the retrofit installation of the system wherein exterior plumbing and valving are minimized.

Obviously, numerous modifications and variations of the present invention are possible in light of the above teachings. It is therefore to be understood that within the scope of the appended claims the invention may be practiced otherwise than as specifically described herein.

I claim:

1. A regenerative fluid system comprising:

a sealed cylindrical housing including a cylinder having a head and a cap attached to opposite ends thereof;

a piston slidably mounted within said cylinder so as to form an extend chamber between said piston and said cap and a retract chamber between said piston and said head;

a rod rigidly attached to said piston and slidably mounted through said head, said rod having a hollowed portion in the end thereof which is attached to said piston whereby a regeneration chamber is formed within said rod, said rod having at least one opening therethrough so as to provide communication between said retract chamber and said regeneration chamber;

a cylindrical regeneration tube attached to said cap and passing through said piston in slidable relation therewith and extending into said regeneration chamber;

a fluid passage within said cap for selected inlet or outlet fluids flow between said extend chamber and the exterior of said cap;

a fluid passage within said head for selected inlet or outlet fluid flow between said retract chamber and the exterior of said system; and a fluid control means within said cap to provide selected fluid flow between said extend chamber and said regeneration chamber.

2. A system as set forth in claim 1 wherein said fluid control means is defined by a cartridge valve mounted between said extend chamber and said regeneration chamber, said cartridge valve disposed for pressurization to a high bias state whereby fluid flow between said extend chamber and said regeneration chamber is prevented when said cartridge valve is in said high bias state, and wherein fluid flow is permitted between said extend chamber and said regeneration chamber when said cartridge valve is in a low bias state responsive to a reduction in said pressurization, and when a predetermined pressure differential is present between said extend chamber and said regeneration chamber.

3. A system as set forth in claim 2 wherein a second fluid control means is mounted in the passage within said head, to provide selected flow between said retract chamber and the exterior of said system.

4. A system as set forth in claim 3 wherein said second fluid control means is a cartridge valve, said cartridge valve disposed for pressurization to a high bias state whereby fluid flow between said retract chamber and the exterior of said system is prevented when said cartridge valve is in said high bias state, and wherein fluid flow is permitted between said retract chamber and the exterior of said system when said cartridge valve is in a low bias state responsive to a reduction in said pressurization, and when a predetermined pressure differential is present between said retract chamber and the exterior of said system.

5. A system as set forth in claim 4 wherein a third fluid control means is mounted in the fluid passage within said cap for flow of selected inlet or outlet fluid flow between said extend chamber and the exterior of said cap, whereby said third fluid control means is adapted to control said selected inlet or outlet fluid flow.

6. A system as set forth in claim 5 wherein said third fluid control means is a cartridge valve.

* * * * *